US009810486B2

(12) United States Patent
Tylutki

(10) Patent No.: US 9,810,486 B2
(45) Date of Patent: Nov. 7, 2017

(54) HEAT EXCHANGER PRESSURE ADJUSTABLE BAFFLE

(71) Applicant: DENSO International America, Inc., Southfield, MI (US)

(72) Inventor: Daniel Tylutki, Livonia, MI (US)

(73) Assignee: DENSO International America, Inc., Southfield, MI (US)

( * ) Notice: Subject to any disclaimer, the term of this patent is extended or adjusted under 35 U.S.C. 154(b) by 779 days.

(21) Appl. No.: 14/135,790

(22) Filed: Dec. 20, 2013

(65) Prior Publication Data

US 2015/0176925 A1 Jun. 25, 2015

(51) Int. Cl.

| | |
|---|---|
| ***G05D 15/00*** | (2006.01) |
| ***F28F 5/00*** | (2006.01) |
| ***F28F 9/02*** | (2006.01) |
| ***F28F 27/02*** | (2006.01) |
| ***F28D 1/053*** | (2006.01) |
| *F28D 21/00* | (2006.01) |

(52) U.S. Cl.

CPC ..... *F28F 5/00* (2013.01); *F28D 1/05325* (2013.01); *F28F 9/0212* (2013.01); *F28F 27/02* (2013.01); *F28D 2021/0089* (2013.01)

(58) Field of Classification Search

CPC ..... F28F 5/00; F28F 9/0212; F28F 9/0263; F28F 9/028; F28F 27/02; F28F 2009/226; F28F 2265/12; F28D 1/05325; F28D 2021/0089

USPC ..... 165/281

See application file for complete search history.

(56) References Cited

U.S. PATENT DOCUMENTS

| | | | | |
|---|---|---|---|---|
| 3,047,274 | A * | 7/1962 | Wilson | F28D 7/022 165/101 |
| 3,487,642 | A * | 1/1970 | Norton | F25B 49/027 165/101 |
| 4,651,820 | A | 3/1987 | Knapp | |
| 5,101,640 | A * | 4/1992 | Fukushima | F25B 49/027 165/101 |
| 5,113,928 | A | 5/1992 | Myers | |
| 5,848,639 | A | 12/1998 | Flesburg et al. | |
| 5,930,910 | A | 8/1999 | Trapp et al. | |
| 5,950,716 | A | 9/1999 | Appelquist et al. | |
| 6,062,303 | A * | 5/2000 | Ahn | F25B 39/04 165/110 |
| 6,073,686 | A * | 6/2000 | Park | F28D 1/05391 165/110 |
| 7,322,399 | B2 * | 1/2008 | Guerrero | F28D 1/0452 165/101 |

(Continued)

FOREIGN PATENT DOCUMENTS

| | | | |
|---|---|---|---|
| EP | 2056042 | A1 | 6/2009 |
| JP | 2009-243702 | A | 10/2009 |

*Primary Examiner* — Travis Ruby

(57) ABSTRACT

A heat exchanger of the type having a tube assembly made up of a number of tubes through which a first medium flows and around and between which a second medium flows to accept heat from, or transfer heat to, the first medium. One of the media is constrained by a baffle to follow a path through the heat exchanger. According to the invention, the baffle is completely separate from the tubes, so permitting the baffle to adjust automatically. The baffle may be carried on springs and the position based on a pressure balance of the first medium, with the result of allowing the first medium to flow through a varying amount of tubes.

7 Claims, 7 Drawing Sheets

(56) References Cited

U.S. PATENT DOCUMENTS

| | | | | |
|---|---|---|---|---|
| 7,854,256 | B2 * | 12/2010 | Pineo | F01M 5/00 165/101 |
| 8,235,101 | B2 * | 8/2012 | Taras | F25B 13/00 165/101 |
| 2003/0047300 | A1 * | 3/2003 | Okumura | B60H 1/00028 165/42 |
| 2003/0234097 | A1 * | 12/2003 | Holub | F01M 5/002 165/41 |
| 2005/0199381 | A1 * | 9/2005 | Mercz | F16K 1/222 165/172 |
| 2006/0191677 | A1 * | 8/2006 | Viczena | F24F 11/06 165/260 |
| 2009/0166022 | A1 * | 7/2009 | Desai | F28D 1/0443 165/279 |
| 2015/0021003 | A1 * | 1/2015 | Cho | F28F 9/0212 165/145 |
| 2015/0176925 | A1 * | 6/2015 | Tylutki | F28F 9/0246 165/96 |
| 2015/0247678 | A1 * | 9/2015 | Tylutki | F28D 1/0233 165/103 |

* cited by examiner

HEAT EXCHANGER PRESSURE ADJUSTABLE BAFFLE

FIELD

This present disclosure relates to the field of automotive heat exchangers, more specifically this disclosure relates oil cooler with adjustable flow baffle.

BACKGROUND

This section provides background information related to the present disclosure which is not necessarily prior art.

In automotive vehicles, it is common to have a series of different heat exchangers transferring heat to or from a variety of liquids or gases. A typical vehicle may contain a heat exchanger to cool a fluid that is used to cool an engine. Charge air coolers are used to cool the air that is being compressed before leading into the intake of an engine. Additional heat exchangers may be used to cool oil that lubricates the internal components of the engine; additionally transmission fluid may also flow through a heat exchanger to maintain the transmission at an optimum temperature. Typical construction of such heat exchangers generally have an inlet or an outlet on one or both of the heat exchanger tanks and may have a fixed baffle to accommodate packaging constraints or increase heat rejection. The baffle is fixed so that the medium entering the inlet passes through a fixed number of tubes and the medium exiting has passed through a fixed number of tubes.

A problem with the conventional fixed baffle heat exchangers is their lack of versatility. Heat exchangers are optimally designed for one application only in accordance with the flow parameters and heat exchange requirements expected in that application and in an optimum condition. Where the heat exchanger designed for one application is used in another application in which the flow rate of the medium to be cooled is greater than the design flow rate, there is usually an unacceptable pressure drop in the system. Or if the viscosity of the fluid can change based on temperature, like oil, there may be an unacceptable pressure drop as well. If, on the other hand, the heat exchanger is used in an application in which the flow rate is less than the design flow rate, there is inefficient heat transfer to the cooling medium.

Heat exchangers with fixed baffle arrangements lack versatility in that it is not possible to cater for different flow parameters and heat exchange requirements. Also if the viscosity of a liquid can change based on its temperature the heat exchanger with fixed baffles cannot adjust to maximized optimum fluid flow limiting pressure drop losses.

A current solution is to install a bypass system. This system would allow the medium, during certain conditions, to bypass the heat exchanger entirely until the correct conditions are met. Such systems add complex components like control modules with sensors to regulate the system driving up overall costs and difficulty in implementation. However, if the heat exchanger was versatile to change the internal baffle position to allow for greater flow during high viscosity period and regulate to an optimum flow during normal operation, there would be no need for complex solutions.

It would be desirable to have a heat exchanger which has greater versatility, and the present development seeks to provide such a heat exchanger.

SUMMARY

This section provides a general summary of the disclosure, and is not a comprehensive disclosure of its full scope or all of its features.

A heat exchanger for transferring heat from a liquid that comprises a first header tank also a second header tank. In between the two tanks are a plurality of tubes, these fluidly join the first header tank and the second header tank. Contained within one of the tanks is a moveable baffle. This baffle may divide one of the first header tank and the second header tank into a first chamber and a second chamber.

An additional embodiment may be an automotive heat exchanger with a plurality of tubes which medium flows through, at least two tanks which connect the tubes and which the heat exchange medium flows in and out. The tank encloses a self-adjusting partition baffle. The baffle is for dividing one of the tank portions into different independent tank chambers. The self-adjusting partition baffle may be resiliently attached to the tank.

An additional embodiment may be an oil cooler for a vehicle with a first end tank divided into a first portion and a second portion. The division is made by an adjustable baffle. An inlet of the tank is at the first portion, the second portion contains an outlet. The oil cooler has a plurality of a first section of tubes in fluid communication with the first portion of the first end tank. The section of first tubes has a fluid that flows to a second end tank. A section of second tubes may be in fluid communication with the second end tank and the second portion of the first end tank. The first end tank also has a first end and a second end, a spring extends from one end and attached to the adjustable baffle and changes the number of the first tubes in fluid communication with the first portion of the first end tank and the second end tank.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
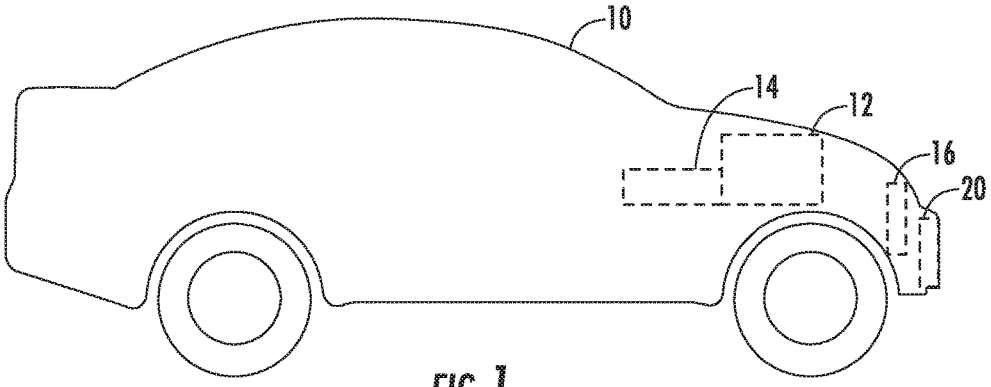
FIG. 1 (PRIOR ART)
FIG. 1 is a schematic representation of a vehicle having a engine, transmission and heat exchangers.

Example embodiments will now be described more fully with reference to the accompanying drawings. The following description is merely exemplary in nature and is not intended to limit the present disclosure, application, or uses. It should be understood that throughout the drawings, corresponding reference numerals indicate like or corresponding parts and features.

Referring to FIG. 1, an automotive vehicle 10 with an engine 12 and transmission 14 representations shown. Vehicle 10 includes heat exchangers at the front of the vehicle 10, a radiator 16 and an oil cooler 20. It is known in the art that the radiator 16 cools an engine coolant (not shown) that flows through the engine 12 and then back to the radiator 16. Additionally the vehicle has a transmission 14 that contains some lubricating fluid (not shown), that fluid may be cooled by oil cooler 20. Also, it is known that the engine 12 has lubricating oil for internal components; this may also be cooled in oil cooler 20. A series of pumps, tubing, and piping is needed to connect the heat exchangers to the engine 12 and transmission 14, this is understood in the art and will not be described in detail.

Figure 2:
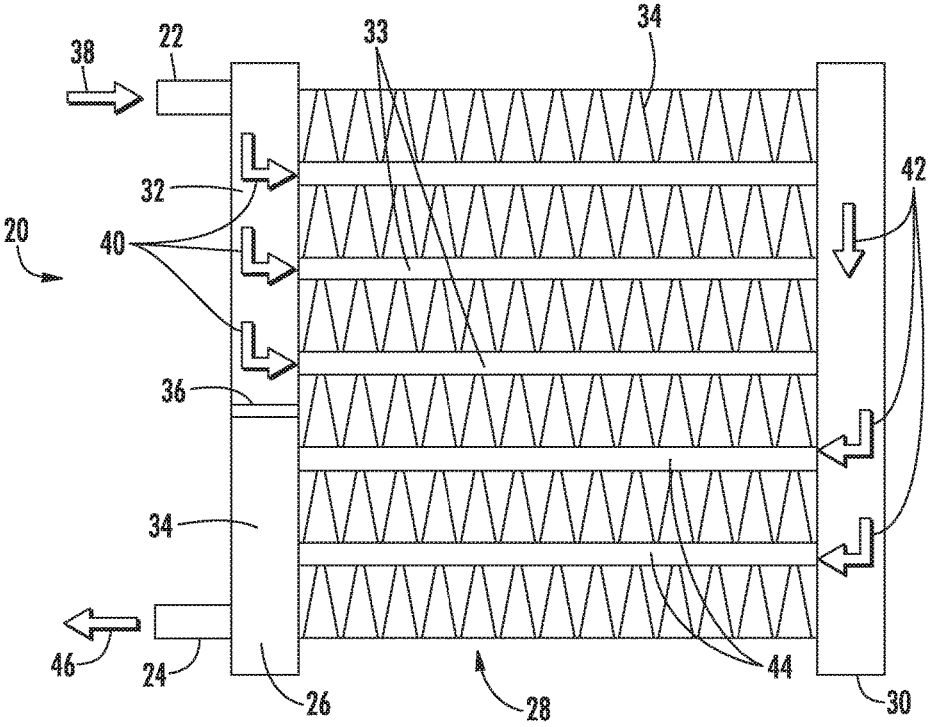
FIG. 2 (PRIOR ART)
FIG. 2 is a representation of the prior art.

With reference to FIG. 2, a typical oil cooler 20 that is used on a typical vehicle is shown, it may be understood that this style of heat exchanger can be used for any fluid. The oil cooler 20 has an inlet 22 and outlet 24 in the first tank 26. A core section 28 connects the first tank 26 to the second tank 30. The core section includes a first plurality of tubes 33, in between the tubes is a series of fins 34. The first tank 26 is separated into two chambers, an inlet chamber 32 and an outlet chamber 34. The two chambers are separated in the first tank 26 by a baffle 36. It is understood in the art that the baffle 36 may be known as a partition, or any piece to isolate the two chambers from each other. The baffle 36 is in a fixed position that separates the medium (not shown) in the inlet chamber 32 and the outlet chamber 34. The typical function of the oil cooler 20 is the oil or liquid medium (not shown) would flow into inlet 22 represented by arrow 38. The medium would fill the inlet chamber 32 and flow through the first portion of tubes 33, the flow is represented by group of arrows 40. The medium flows through the first portion tubes 33 into the second tank 30. The second tank 30 is just a single chamber with no baffles or partitions, however it is understood in the art that oil coolers or any heat exchangers can be incorporated with each other and share end tanks. The medium represented by arrows 42, flows down tank 30 and into second portion of tubes 44. The medium then flows back to the first tank 26 to the second chamber 34 and out the outlet 24, the flow represented by arrow 46.

With reference to FIG. 3 A, the oil cooler 50 is very similar to the current art. The oil cooler 50 has an inlet 52 and outlet 54 in the first tank 56. A core section 58 connects the first tank 56 to the second tank 60. The core section includes a first plurality of tubes 63, in between the tubes is a series of fins 65. The first tank 26 is separated into two chambers, an inlet chamber 62 and an outlet chamber 64. The two chambers are separated in the first tank 56 by an adjustable baffle 66. The adjustable baffle 66 separates the medium (not shown) in the inlet chamber 62 and the outlet chamber 64. The typical function of the oil cooler 50 is the oil or liquid medium (not shown) would flow into inlet 52. The medium would fill the inlet chamber 62 and flow through the tubes 63. The medium flows through the tubes 63 into the second tank 60. The second tank 60 is just a single chamber with no baffles or partitions, the medium flows down tank 60 and into second portion of tubes 68. The medium then flows back to the first tank 56 to the outlet chamber 64 and out the outlet 54.

The adjustable baffle 66 is moveable within the tank 56, track rails 70 and 72 may be inside the tank for the baffle 66 to ride against and stay perpendicular to the tank 56. The adjustable baffle 66 position is based upon the pressure balance of the inlet pressure represented by arrow 74 and outlet pressure represented by arrow 76. As shown in FIG. 3B, during a cold vehicle start up condition the oil viscosity is increased due to the decreased temperature. This increases the pressure inside the inlet chamber 62 of the first tank 56. In this condition, the baffle 66 is pushed downward in the tank 56 by the inlet pressure 74 which allows for the number of tubes 63 connected to the inlet chamber 62 to be greater in relation to the number of tubes 68 connected to the outlet chamber 64 when the viscosity is higher. The flow path is maintained the same as described above. It can be appreciated in the art that as the vehicle is driven more the oil in the engine 12 or transmission 14 that will warm up and become less viscous. This reduces the pressure 74 in inlet chamber 62 of the tank 56, the reduction in pressure will allow the baffle 66 to move back into a neutral position as shown in FIG. 3B. Additionally, the warm medium that is being cooled in the core section 58 will become more viscous, this may increase the pressure 76 in the outlet chamber 64. The increase in pressure 76 will push the baffle 66 back into a neutral position in the tank 56. While the vehicle 10 is in normal operation the baffle 66 position will be balanced by pressures 74 and 76.

Figure 3A:
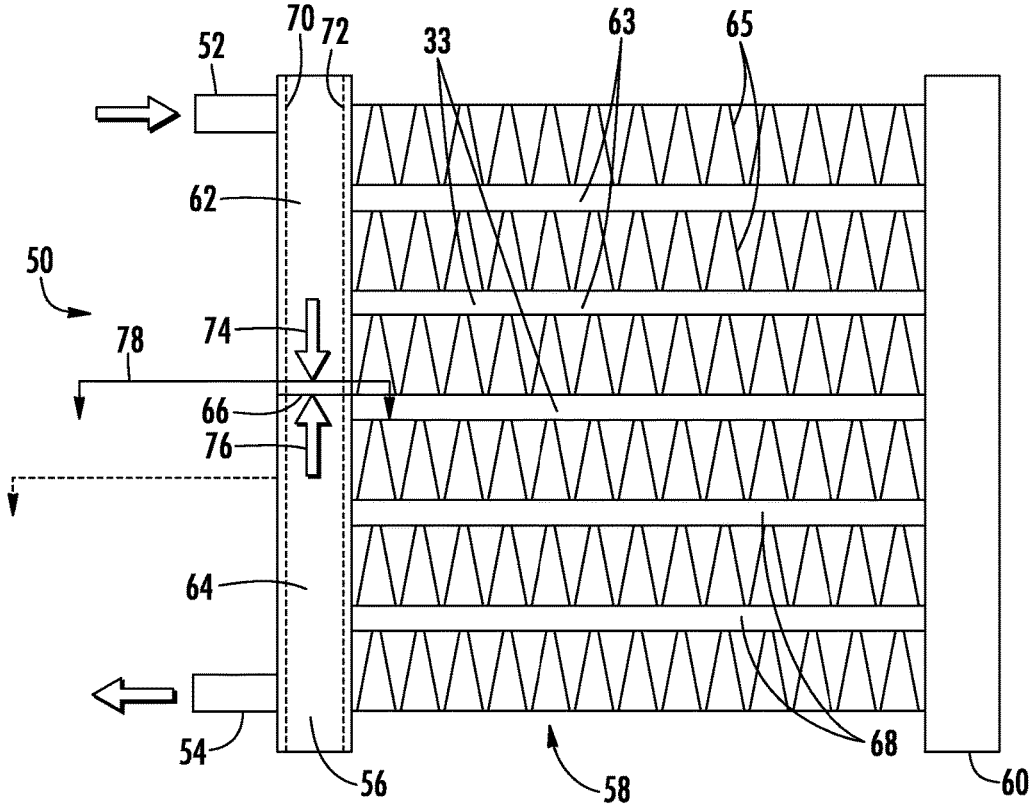
FIG. 3A is a representation of the current embodiment.
Figure 3B:
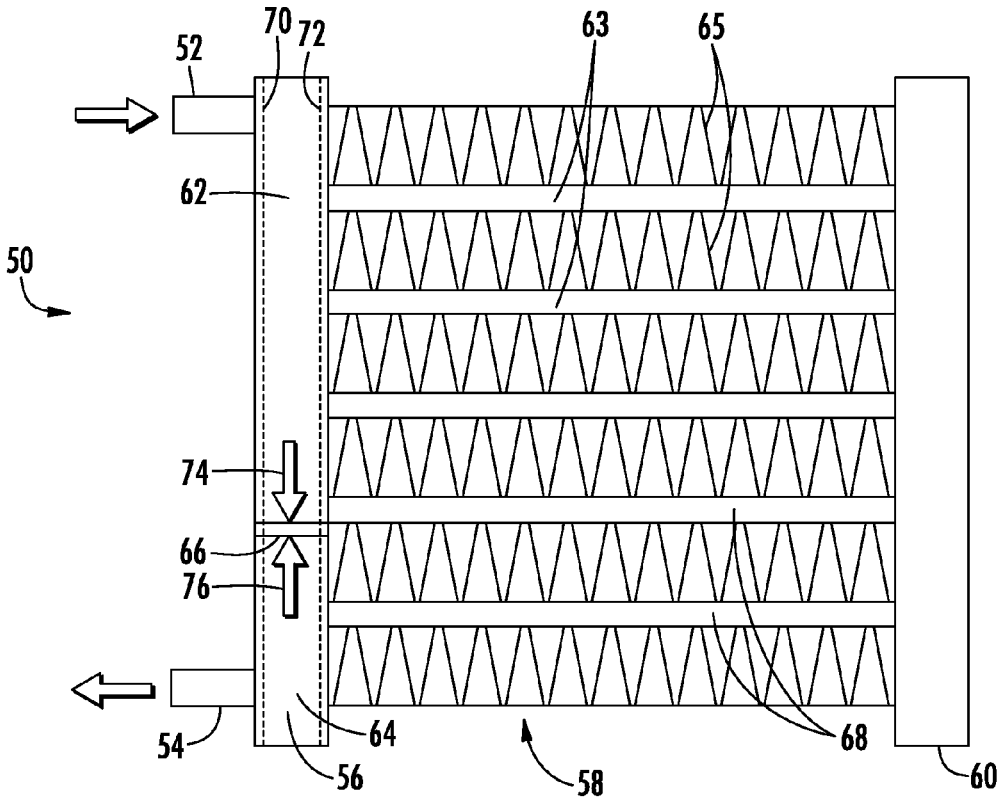
FIG. 3B is a representation of the current embodiment.
Figure 4A:
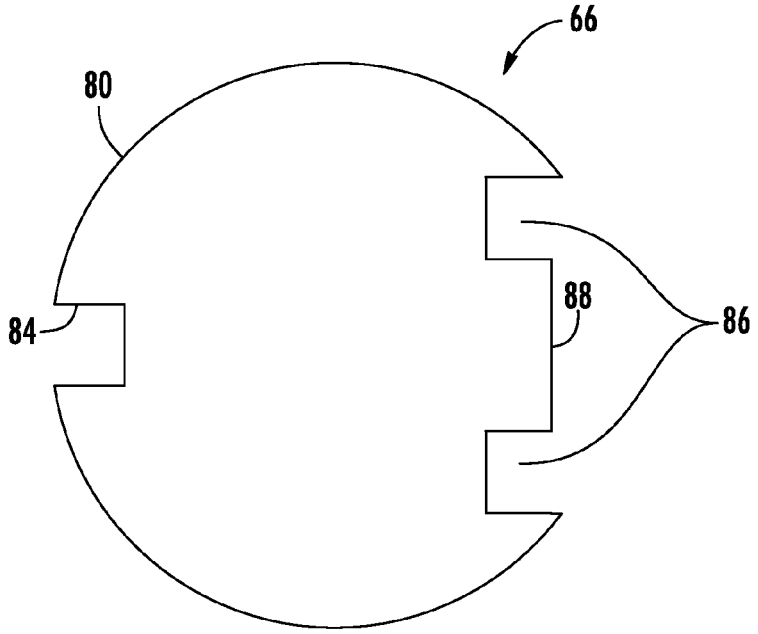
FIG. 4A is view of the baffle.
Figure 4B:
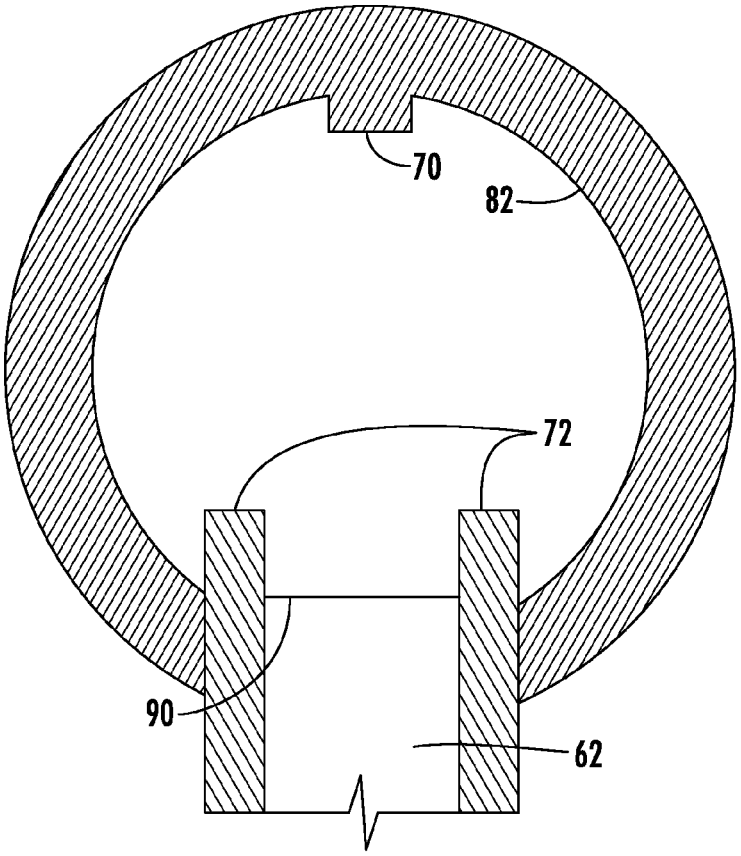
FIG. 4B is a cutout view of the tank.

Referring to FIG. 4A and FIG. 4B, the baffle 66 and cross-section cut 78 of the tank 56 from FIG. 3A is shown. The baffle 66 has the same perimeter periphery as the inside shape of the tank 56. A semi-circular shape is shown, however it is appreciated in the art that heat exchanger tanks can be a variety of shapes, square, rectangular, circular, or any combination by way of non-limiting example. It is also understood in the art that the heat exchanger tank 56 may be of many different materials, common in the art are a plastic/polymer material, aluminum, copper or steel by way of non-limiting example. The baffle 66 may also be made of any variety of material, currently in the art baffles may be made of any synthetic material such as rubber, plastic/polymer, or metallic material may be used such as aluminum or any combination thereof. The baffle 66 may be made of a metal material with an outer ridge of synthetic material (not shown) as an example. The baffle 66 has a general outer perimeter periphery 80 that is substantially the same shape of the inner surface 82 of the tank 56. The tank 56 may include track rails 70 and 72 to guide the baffle 66, cutouts 84, and 86 may be incorporated in the baffle to help control the position. Edge 88 of the baffle interfaces with the inlet 90 of the tubes 62 of the core section 58.

Figure 5A:
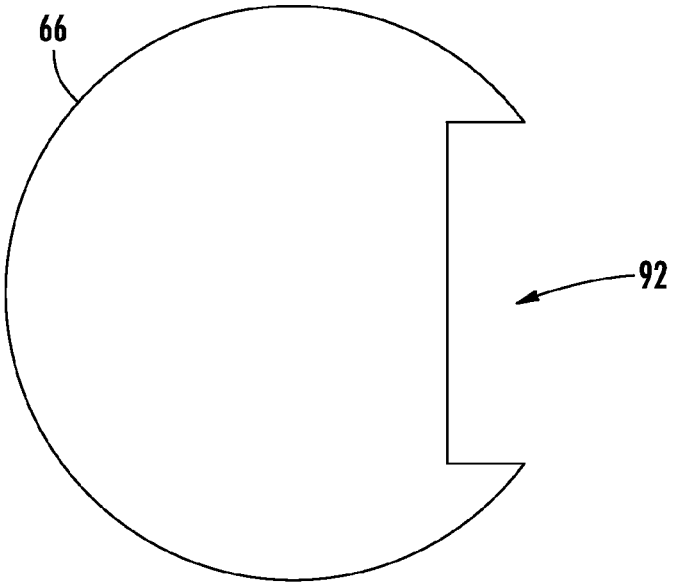
FIG. 5A is view of the baffle.
Figure 5B:
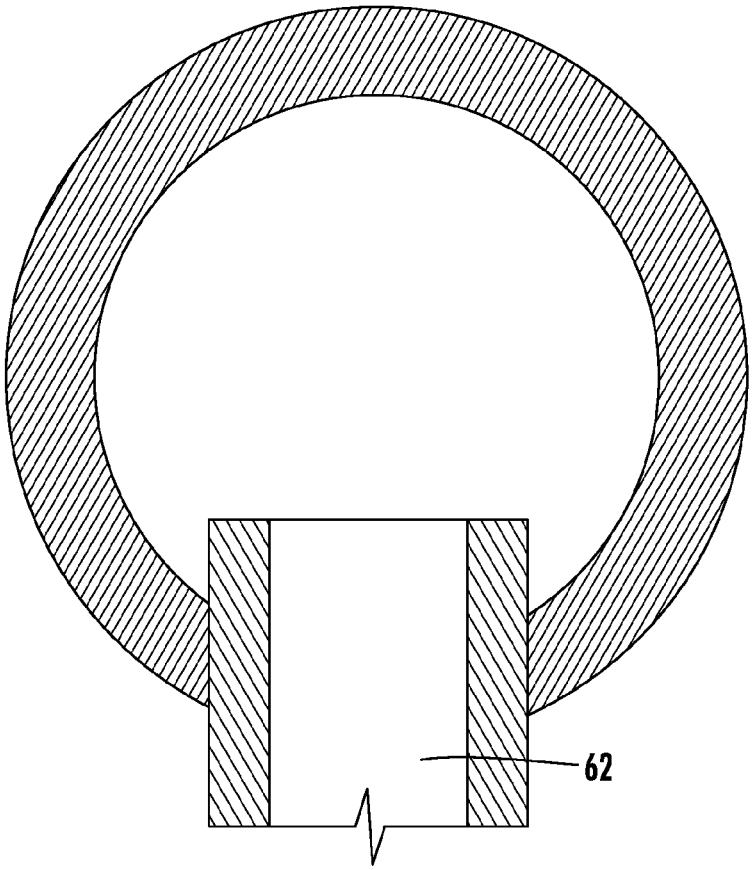
FIG. 5B is a cutout view of the tank

Referring to FIGS. 5A and 5B It can be appreciated by one in the art that the track rails 70 and 72 may not needed for the adjusting baffle 66 if the tubes 62 protrude into the inlet and outlet chambers 62 and 64. The baffle 66 may have a cut out 92 substantially the same shape of the tubes 62, and the tubes act as a track rail to maintain the baffle 66 position.

Figure 6A:
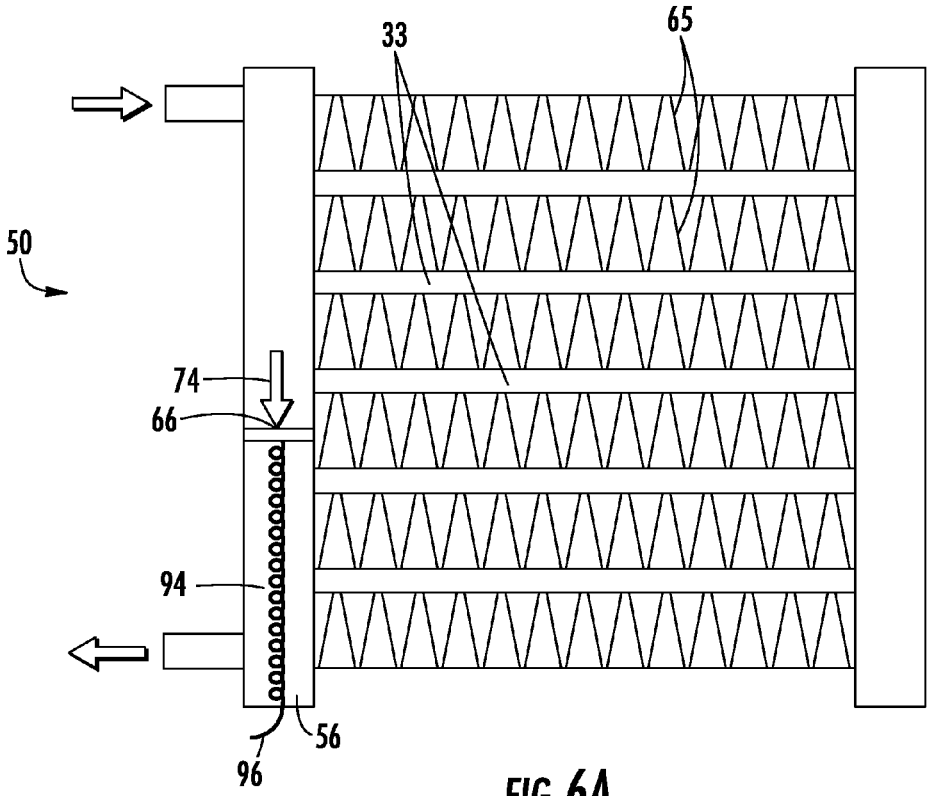
FIG. 6A is a perspective of an additional embodiment.
Figure 6B:
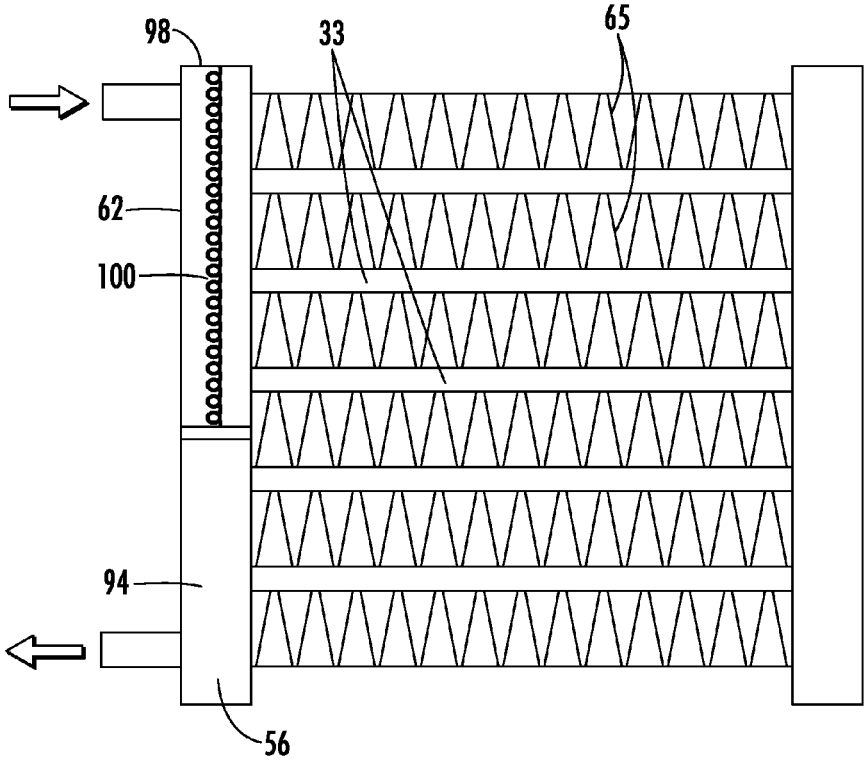
FIG. 6B is a perspective of an additional embodiment.
Figure 6C:
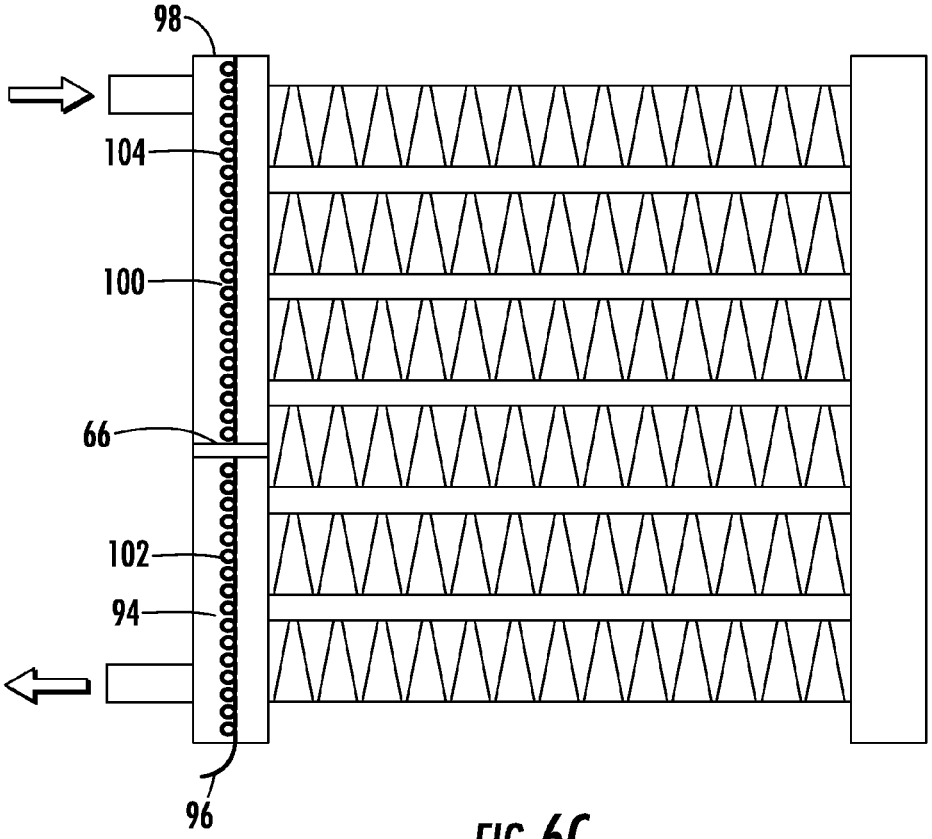
FIG. 6C is a perspective of an additional embodiment.

A additional embodiment in FIG. 6A may have a resilient member further described as a spring 94 may extend from the bottom end 96 of the outlet chamber 64 of the tank 56. The spring may assist in the positioning, to a neutral position, of the adjusting baffle 66 as the inlet pressure decreases. It can be appreciated by one in the art that a spring 100 may also extend from a top end 98 of the inlet chamber 62 of tank 56, as shown in FIG. 6B. Another embodiment may have springs 102 and 104, extend from both ends 96, and 98 as shown in FIG. 6C, and attach to baffle 66. The springs disclosed can be any resilient member to help assist the positioning of the baffle 66 within the tank 56. Attachment of the spring 94, 100, 102, 104 to the baffle 66 may be any attachment means like a rivet, nut and bolt, weld, molded over, epoxy by way of non-limiting example. The same means may be used to attach the spring 94, 100, 102, 104 to the tank 56.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A heat exchanger for transferring heat from a liquid comprising:

a first header tank;

a second header tank;

a plurality of tubes fluidly joining the first header tank and the second header tank, a moveable baffle which is provided within the first header tank, dividing the first header tank into a first chamber and a second chamber; and a plurality of track rails disposed inside the first header tank that guides the moveable baffle, wherein the moveable baffle position changes a quantity of the plurality of tubes in fluid communication with the first chamber and second chamber.

2. The heat exchanger for transferring heat from a liquid according to claim 1, wherein the first header tank has an inlet and an outlet.

3. The heat exchanger for transferring heat from a liquid according to claim 2, wherein the inlet fluidly communicates with the first chamber and the outlet fluidly communicates with the second chamber.

4. The heat exchanger for transferring heat from a liquid according to claim 3, wherein the position of the moveable baffle is based on the pressure of the fluid at the inlet and outlet of the tank.

5. The heat exchanger for transferring heat from a liquid according to claim 1, wherein the first header tank and the second header tank both have a first end and a second end.

6. The heat exchanger for transferring heat from a liquid according to claim 5, further comprising a spring attached to one of the first end or second end of the first or second tank and the spring is attached to the moveable baffle.

7. The heat exchanger for transferring heat from a liquid according to claim 1, wherein the baffle is substantially the same shape as the interior cross section of the tank.

* * * * *